US011017937B2

(12) United States Patent
Hsieh et al.

(10) Patent No.: US 11,017,937 B2
(45) Date of Patent: May 25, 2021

(54) VARIABLE COUPLED INDUCTOR

(71) Applicant: CYNTEC CO., LTD., Hsinchu (TW)

(72) Inventors: Lan-Chin Hsieh, Kaohsiung (TW); Cheng-Chang Lee, Yunlin County (TW); Chih-Hung Chang, Miaoli County (TW); Chih-Siang Chuang, Hsinchu (TW); Tsung-Chan Wu, Hsinchu County (TW); Roger Hsieh, Hsinchu County (TW)

(73) Assignee: CYNTEC CO., LTD., Hsinchu (TW)

( * ) Notice: Subject to any disclaimer, the term of this patent is extended or adjusted under 35 U.S.C. 154(b) by 122 days.

(21) Appl. No.: 15/972,238

(22) Filed: May 7, 2018

(65) Prior Publication Data

US 2018/0254137 A1 Sep. 6, 2018

Related U.S. Application Data

(63) Continuation of application No. 14/967,307, filed on Dec. 13, 2015, now Pat. No. 9,991,041, which is a (Continued)

(30) Foreign Application Priority Data

Aug. 21, 2012 (TW) ..... 101130231

(51) Int. Cl.
*H01F 27/28* (2006.01)
*H01F 27/24* (2006.01)
(Continued)

(52) U.S. Cl.
CPC ..... *H01F 27/24* (2013.01); *H01F 3/14* (2013.01); *H01F 17/04* (2013.01);
(Continued)

(58) Field of Classification Search
CPC ..... H01F 27/24; H01F 27/2823; H01F 3/14; H01F 17/04; H01F 38/023; H01F 2003/106
(Continued)

(56) References Cited

U.S. PATENT DOCUMENTS 2,930,997 A * 3/1960 Fisher ..... H01F 38/10 336/160
3,546,571 A * 12/1970 Fletcher ..... G05F 3/06 323/309
(Continued)

FOREIGN PATENT DOCUMENTS

JP 2007053330 A * 3/2007 ..... H01F 38/10

*Primary Examiner* — Mang Tin Bik Lian
(74) *Attorney, Agent, or Firm* — Min-Lee Teng; Litron Patent & Trademark Office

(57) ABSTRACT

A variable coupled inductor comprises a first core having a first protrusion, a second protrusion, a third protrusion, a first conducting-wire groove and a second conducting-wire groove on the top surface of the first core, wherein the second protrusion is disposed between the first protrusion and the third protrusion, wherein a first conducting wire is disposed in the first conducting-wire groove, and a second conducting wire is disposed in the second conducting-wire groove, wherein a second core, disposed over the first core, wherein a magnetic structure is integrally formed with the second core and protruded on the bottom surface of the second core, wherein the bottom surface of the magnetic structure is located over the top surface of the second protrusion.

12 Claims, 11 Drawing Sheets

Related U.S. Application Data continuation of application No. 13/969,486, filed on Aug. 16, 2013, now Pat. No. 9,251,944.

(51) Int. Cl.

| | |
|---|---|
| ***H01F 17/04*** | (2006.01) |
| ***H01F 3/14*** | (2006.01) |
| ***H01F 38/02*** | (2006.01) |
| *H01F 3/10* | (2006.01) |

(52) U.S. Cl.
CPC ..... *H01F 27/2823* (2013.01); *H01F 38/023* (2013.01); *H01F 2003/106* (2013.01)

(58) Field of Classification Search
USPC ..... 336/212, 221, 178, 220
See application file for complete search history.

(56) References Cited

U.S. PATENT DOCUMENTS 4,728,918 A * 3/1988 Neusser ..... H01F 38/023 336/155
4,795,959 A * 1/1989 Cooper ..... G05F 3/06 307/3
6,510,109 B2 * 1/2003 Ohmori ..... G11B 11/10534 360/234.7
6,774,758 B2 * 8/2004 Gokhale ..... H01F 3/14 336/110
6,980,077 B1 * 12/2005 Chandrasekaran ... H01F 27/255 336/212
2005/0151614 A1 * 7/2005 Dadafshar ..... H01F 27/255 336/223
2005/0258927 A1 * 11/2005 Lu ..... H01F 27/245 336/234
2008/0303624 A1 * 12/2008 Yamada ..... H01F 3/14 336/212
2010/0085138 A1 * 4/2010 Vail ..... H01F 3/14 336/216
2010/0176909 A1 * 7/2010 Yasuda ..... H01F 3/12 336/233
2010/0328007 A1 * 12/2010 Witzani ..... H01F 3/14 336/178
2012/0161916 A1 * 6/2012 Eng ..... H01F 3/14 336/212
2013/0207767 A1 * 8/2013 Worthington ..... H01F 27/2804 336/84 C
2014/0266535 A1 * 9/2014 Willis ..... H01F 27/24 336/178

* cited by examiner

VARIABLE COUPLED INDUCTOR

CROSS-REFERENCE TO RELATED APPLICATIONS

This application is a continuation of U.S. application Ser. No. 14/967,307, filed on Dec. 13, 2015, which is a continuation of U.S. application Ser. No. 13/969,486, filed on Aug. 16, 2013, which claims the benefit of priority of Taiwan Application No. 101130231, filed on Aug. 21, 2012, each of which is incorporated by reference herein in their entirety.

BACKGROUND OF THE INVENTION

I. Field of the Invention

The present invention relates to a variable coupled inductor and, in particular, to a variable coupled inductor can improve efficiency in both light-load and heavy-load situations.

II. Description of the Prior Art

A coupled inductor has been developed for a period of time; however, it is not often used in the circuit board. As a more powerful microprocessor needs a high current in a small circuit board, a variable coupled inductor has been gradually used in the circuit board. A variable coupled inductor can be used to reduce the total space of the circuit board consumed by traditional coupled inductors. Currently, a coupled inductor can reduce the ripple current apparently, wherein a smaller capacitor can be used to save the space of the circuit board. As the DC resistance (direct current resistance, DCR) of the coupled inductor is low, efficiency is better in a heavy-load situation. However, as the flux generated by each of the dual conducting wires will be cancelled each other when the dual conducting wires are coupled, the inductance becomes low and the efficiency becomes worse in a light-load situation.

SUMMARY OF THE INVENTION

One objective of present invention is to provide a variable coupled inductor that can increase the efficiency in both heavy-load and light-load situations to solve the above-mentioned problem.

In one embodiment, a variable coupled inductor is provided, wherein variable coupled inductor comprises a first core comprising a first protrusion, a second protrusion, a third protrusion, a first conducting-wire groove and a second conducting-wire groove, wherein the second protrusion is disposed between the first protrusion and the third protrusion, the first conducting-wire groove is located between the first protrusion and the second protrusion, and the second conducting-wire groove is located between the second protrusion and the third protrusion; a first conducting wire disposed in the first conducting-wire groove; a second conducting wire disposed in the second conducting-wire groove; a second core disposed over the first core, wherein a first gap is formed between the first protrusion and the second core, a second gap is formed between the second protrusion and the second core and a third gap is formed between the third protrusion and the second core; and a magnetic structure disposed between the second protrusion and the second core, wherein the magnetic structure is symmetric with respect to the central line of the second protrusion.

The present invention proposes that the magnetic structure is disposed between the second projection in the middle of the first core and the second core, wherein the magnetic structure is symmetric with respect to the central line CL of the second protrusion 102. Therefore, the initial-inductance of the variable coupled inductor can be enhanced and light-load efficiency can be improved by means of the magnetic structure.

In one embodiment, the material of the variable coupled inductor of the present invention can be a ferrite material to achieve a high-saturation current, and copper sheet is used as an electrode to reduce the DC resistance so that the efficiency in heavy-load is improved.

BRIEF DESCRIPTION OF THE DRAWINGS

The foregoing aspects and many of the accompanying advantages of this invention will become more readily appreciated as the same becomes better understood by reference to the following detailed description when taken in conjunction with the accompanying drawings, wherein:

FIG. 4A and FIG. 4B each illustrates a side view of the variable coupled inductor in FIG. 1 where the second conducting wire is removed, wherein FIG. 4B shows a non-magnetic material is filled into the gaps between the second core and the first core;

DETAILED DESCRIPTION OF THE INVENTION

Figure 1:
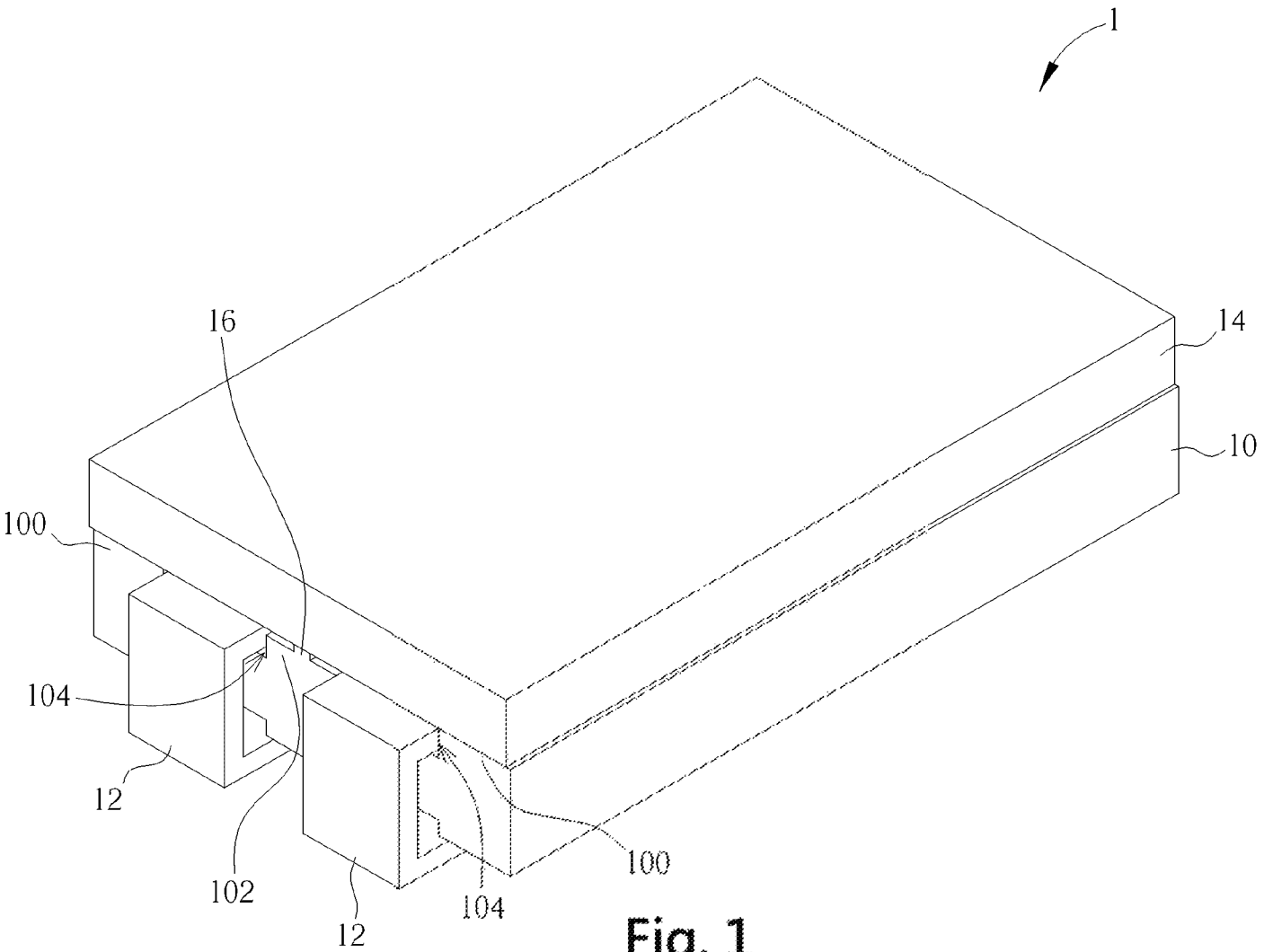
FIG. 1 illustrates a variable coupled inductor in three dimensions in accordance with one embodiment of present invention.
Figure 2:
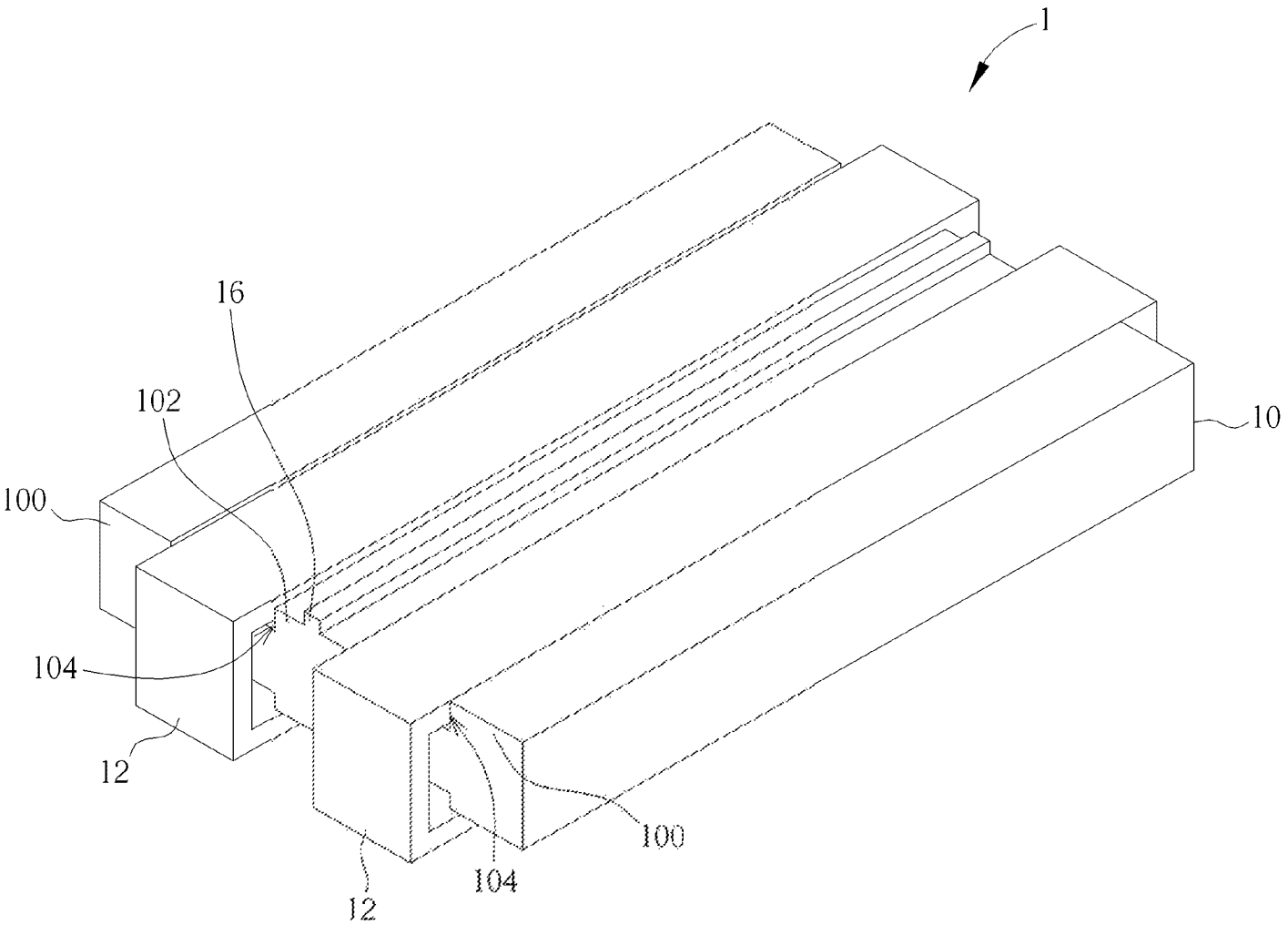
FIG. 2 illustrates the variable coupled inductor in FIG. 1 where the second core is removed.
Figure 3:
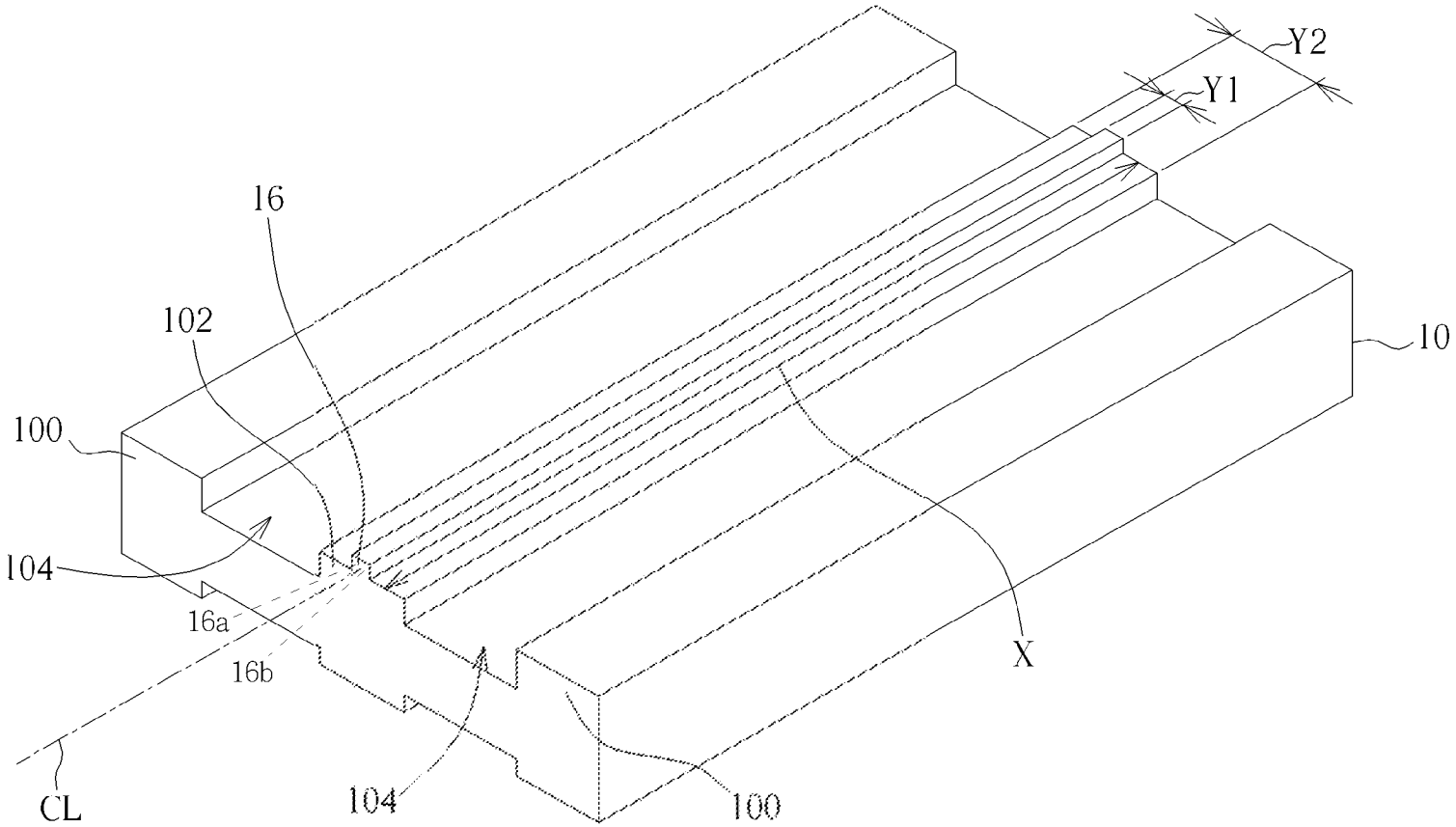
FIG. 3 illustrates the first core and the magnetic structure of the variable coupled inductor in FIG. 2.
Figure 4A:
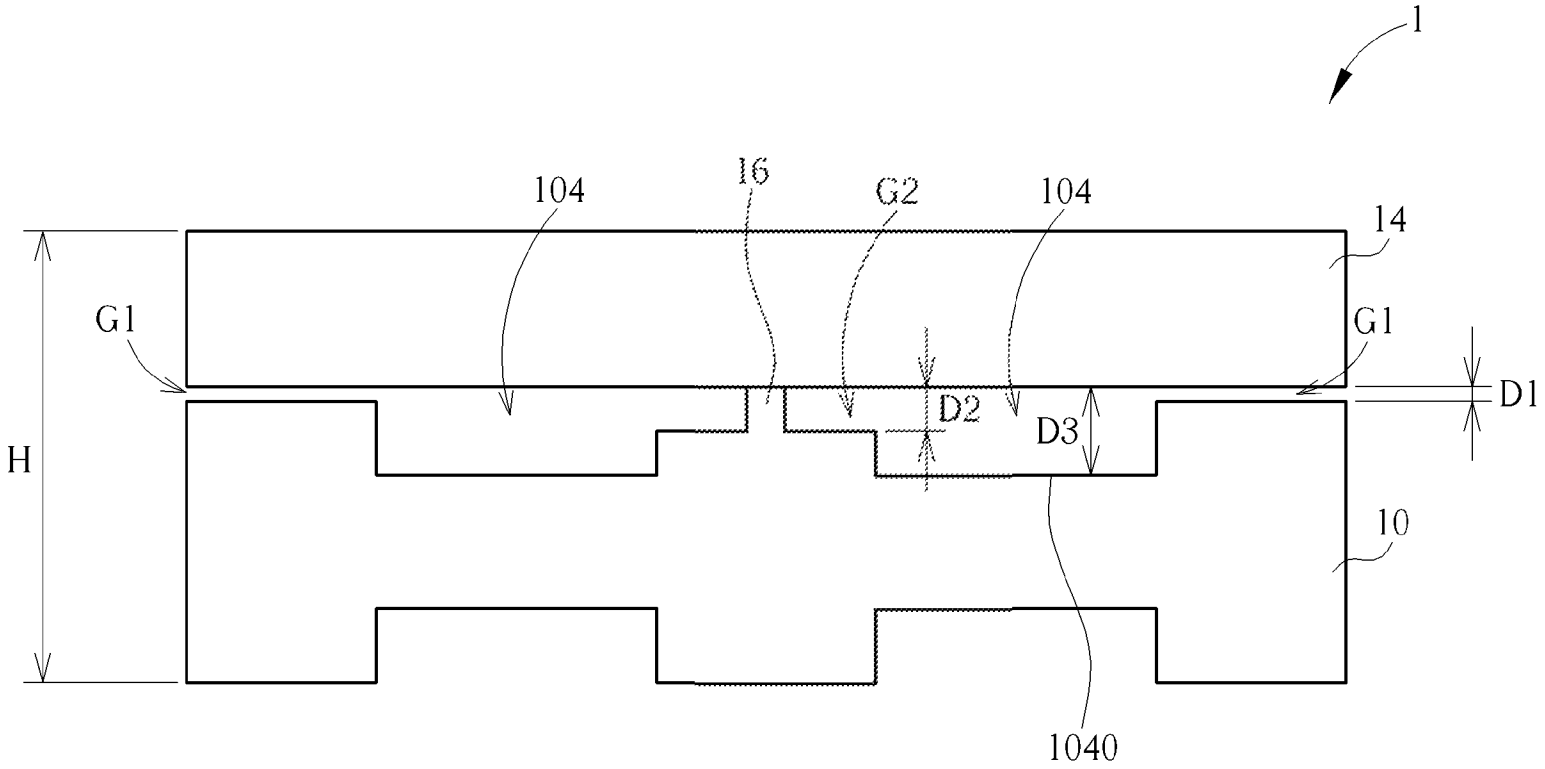

Please refer to FIG. 1 to FIG. 4A. FIG. 1 is a three-dimensional view of a variable coupled inductor 1 according to one embodiment of the present invention. FIG. 2 is a three-dimensional view of a variable coupled inductor 1 where the second core 14 is removed in FIG. 1. FIG. 3 is a three-dimensional view of a first core 10 and a magnetic structure 16 in FIG. 2. FIG. 4A is a lateral view of a variable coupled inductor 1 wherein two conducting wires 12 are removed in FIG. 1. As illustrated in FIG. 1 to FIG. 4A, the variable coupled inductor 1 comprises a first core 10, two conducting wires 12, a second core 14 and a magnetic structure 16. The first core 10 comprises two first protrusions 100, a second protrusion 102 and two conducting-wire grooves 104, wherein the second protrusion 102 is located between the two first protrusions 100, and each of the two conducting-wire groove 104 is located between corresponding one of the two first protrusions 100 and the second protrusion 102, respectively. In other words, the second protrusion 102 is located in the middle portion of the first core 10. Each of the two conducting wire 12 is disposed in one of the two conducting-wire grooves 104, respectively. The second core 14 is disposed over the first core 10 so that a first gap G1 is formed between each first protrusion 100 and the second core 14 and a second gap G2 is formed between the second protrusion 102 and the second core 14. A magnetic structure 16 is disposed between the second protrusion 102 and the second core 14, and the magnetic structure 16 is symmetric with respect to the central line CL of the second protrusion 102, as illustrated in FIG. 3 and FIG. 4A.

Figure 4B:
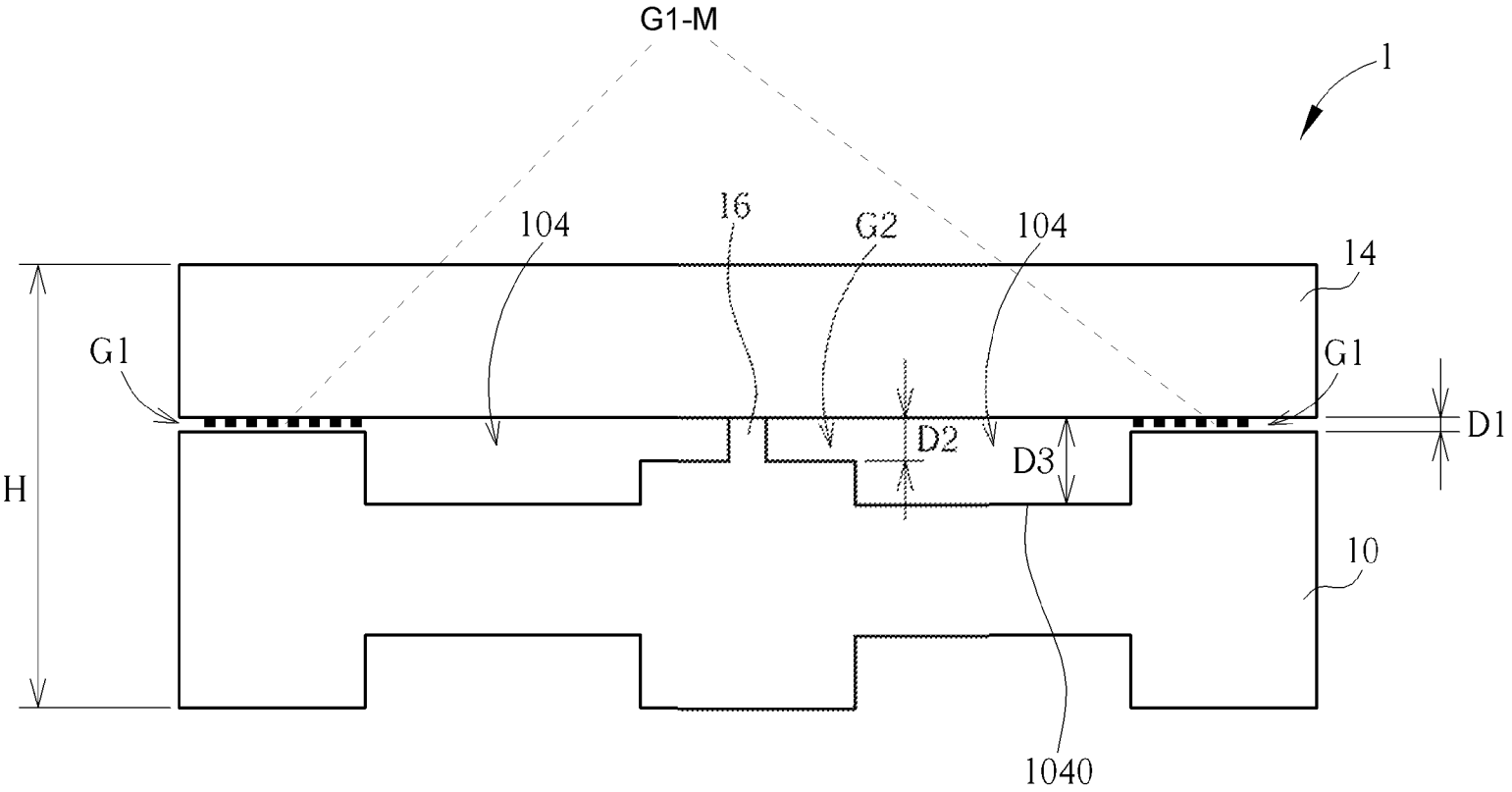
Figure 4C:
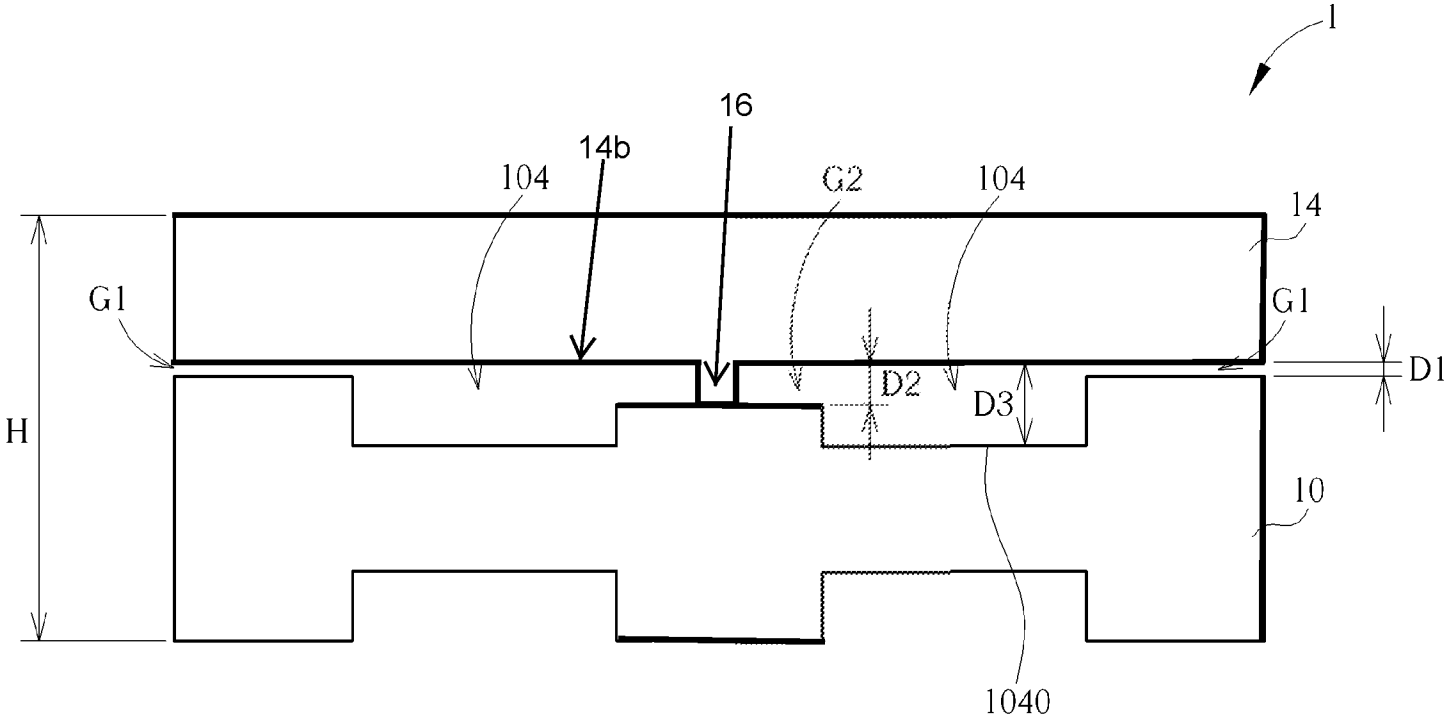
FIG. 4C illustrates a side view of the variable coupled inductor, wherein the magnetic structure is integrated formed with the second core.

As the second protrusion 102 is located in the middle portion of the first core 10 and the magnetic structure 16 is disposed between the second protrusion 102 and the second core 14, the magnetic structure 16 is located in the middle portion of the variable coupled inductor 1 after the variable coupled inductor 1 is fabricated. Furthermore, two ends of the magnetic structure 16 are respectively in full contact with the first core 10 and the second core 14. In this embodiment, magnetic structure 16 is, but not limited to, in a long-strip shape. In this embodiment, the material of the first core 10, the second core 14 and the magnetic structure 16 can be iron powder, ferrite, a permanent magnet or other magnetic material. Because the first core 10 and the magnetic structure 16 are integrally formed, the material of the first core 10 is the same as that of the magnetic structure 16. In another embodiment, the magnetic structure 16 and the second core 14 are also formed integrally, as shown in FIG. 4C, wherein the magnetic structure 16 is protruded on the bottom surface 14*b* of the second core 14, in such case, the material of the second core 14 is the same as that of the magnetic structure 16. In another embodiment, the magnetic structure 16 can be also an independent device, in such case, the material of the magnetic structure 16 and the material of the first core 10, or the second core 14, can be the same or different. It should be noted that if the magnetic structure 16 is not in full contact with the first core 10 and the second core 14 due to manufacturing tolerance, magnetic glue can be filled in the gap (e.g., insulating resin and magnetic adhesive made of magnetic powder).

Figure 4D:
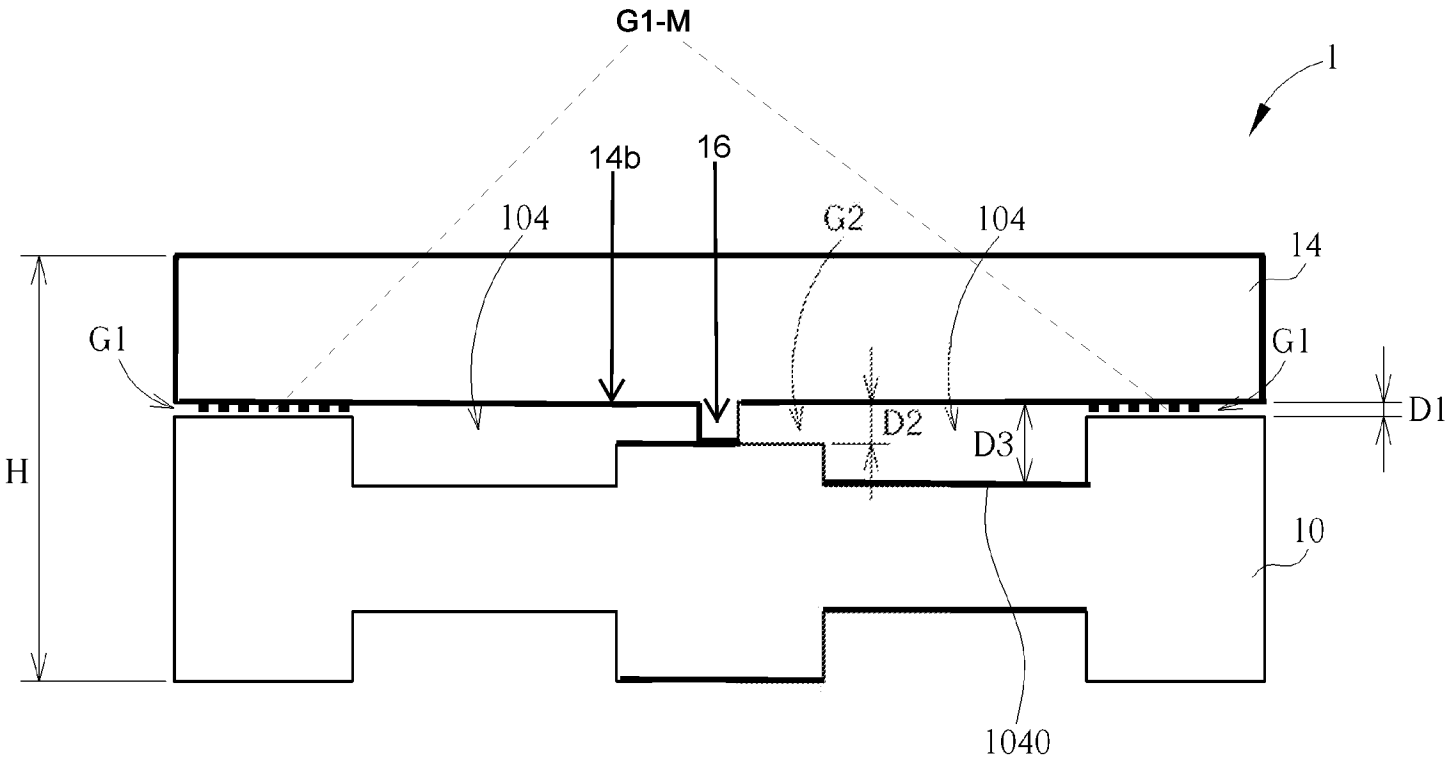
FIG. 4D illustrates a side view of the variable coupled inductor, wherein the magnetic structure is integrated formed with the second core, and a non-magnetic material is filled into the gaps between the second core and the first core.

In this embodiment, as shown FIG. 4A and FIG. 4C, the vertical distance D1 of the first gap G1 is smaller than the vertical distance D2 of the second gap G2. The first gap G1 can be an air gap, a magnetic gap and a non-magnetic gap, and the second gap G2 can be also an air gap, a magnetic gap and a non-magnetic gap. The first gap G1 and the second gap G2 can be designed according to the practical application. It should be noted that the air gap is a gap filled with air for isolating and it does not contain other material; because air has a greater magnetic reluctance, it can increase the degree of saturation of the inductor. The magnetic gap is formed by filling the magnetic material in the gap to reduce the magnetic reluctance and to further increase the inductance; as shown in FIG. 4B and FIG. 4D, the non-magnetic gap is formed by filling the non-magnetic material G1-M, except the air, in the gap to enhance the function that the air gap can not achieve, such as by filling a bonding glue to combine different magnetic materials. Preferably, the first gap G1 can be a non-magnetic gap, and the second gap G2 can be an air gap or a non-magnetic gap.

In this embodiment, the variable coupled inductor 1 has a total high H after the variable coupled inductor 1 is fabricated; the vertical distance D1 of the first gap G1 can be in a range between 0.0073H and 0.0492H and the vertical distance D2 of the second gap G2 can be in a range between 0.0196H and 0.1720H. Furthermore, as illustrated in FIG. 4A, each of the first gap G1 and the second gap G2 lies within a height covered by the vertical distance D3 between the bottom surface of the conducting-wire groove 104 and the second core 14. In other words, when looking at the side view shown in FIG. 4A, each top point of the first gap G1 and the second gap G2 is not higher than the top point of vertical distance D3 between the bottom surface of the conducting-wire groove 104 and the second core 14; and each bottom point of the first gap G1 and the second gap G2 is not lower than the bottom point of vertical distance D3 between the bottom surface of the conducting-wire groove 104 and the second core 14. In practical applications, the first gap G1 generates a major inductance and the second gap G2 generates a leakage inductance.

In this embodiment, the magnetic structure 16 has a first magnetic permeability $\mu 1$, the first gap G1 has a second magnetic permeability $\mu 2$, and the second gap G2 has a third magnetic permeability $\mu 3$, wherein the relationship between the first magnetic permeability $\mu 1$, the second magnetic permeability $\mu 2$ and the third magnetic permeability $\mu 3$ is $\mu 1 > \mu 2 \geq \mu 3$. In general, magnetic permeability is inversely proportional to the magnetic reluctance (i.e. the greater the magnetic permeability, the smaller the magnetic reluctance). The first magnetic permeability $\mu 1$ of the magnetic structure 16 is greater than each of the second magnetic permeability $\mu 2$ of the first gap G1 and the third magnetic permeability $\mu 3$ of the second gap G2, wherein the first gap G1 and the second gap G2 are located in two sides of the magnetic structure 16, respectively. In other words, the magnetic reluctance of the magnetic structure 16 is smaller than that of the first gap G1; and the magnetic reluctance of the magnetic structure 16 is smaller than that of the second gap G2.

For example, the magnetic structure 16 can be manufactured by LTCC (low temperature co-fired ceramic, LTCC) printing; in such case, the first magnetic permeability $\mu 1$ of the magnetic structure 16 is about between 50 and 200, and each of the second magnetic permeability $\mu 2$ of the first gap G1 and the third magnetic permeability $\mu 3$ of the second gap G2 is about 1. Because the first magnetic permeability $\mu 1$ of the magnetic structure 16 is greater than each of the second magnetic permeability $\mu 2$ of the first gap G1 and the third magnetic permeability $\mu 3$ of the second gap G2, the initial flux will pass through the magnetic structure 16 when a current passes through variable coupled inductor 1. It should be noted that the first magnetic permeability $\mu 1$ of the magnetic structure 16 is greater than each of the second magnetic permeability $\mu 2$ of the first gap G1 and the third magnetic permeability $\mu 3$ of the second gap G2 to achieve the effect of the variable inductance coupling regardless of the material of the first core 10 and the second core 14 (i.e. regardless of the magnetic permeability of the first core 10 and the second core 14).

Furthermore, the first core 10 has a fourth magnetic permeability $\mu 4$, and the second core 14 has a fifth magnetic permeability $\mu 5$. For example, in another embodiment, when the magnetic structure 16, the first core 10 and the second core 14 are all made of ferrite material, the first magnetic permeability the fourth magnetic permeability μ4 and the fifth magnetic permeability μ5 are the same. When the material of the magnetic structure 16 is ferrite material, the initial-inductance characteristic of the variable coupled inductor 1 can be enhanced and the efficiency of the variable coupled inductor 1 in a light-load situation can be improved as well. It should be noted that the relationship between the first magnetic permeability the second magnetic permeability μ2, the third magnetic permeability μ3, the fourth magnetic permeability μ4 and the fifth magnetic permeability μ5 is: μ1≥μ4≥μ2≥μ3 and μ1≥μ5>μ2≥μ3, regardless of the material of the magnetic structure 16, the first core 10 and the second core 14.

In summary, the present invention proposes that the magnetic structure 16 having a high magnetic permeability (i.e. the first magnetic permeability μ1 described above) is disposed between the second projection 102 in the middle of the first core 10 and the second core 14, and the magnetic structure 16 is symmetric with respect to the central line CL of the second protrusion 102. Therefore, by using the magnetic structure 16, the initial-inductance of the variable coupled inductor 1 can be enhanced and efficiency can be improved in a light-load situation.

Figure 5:
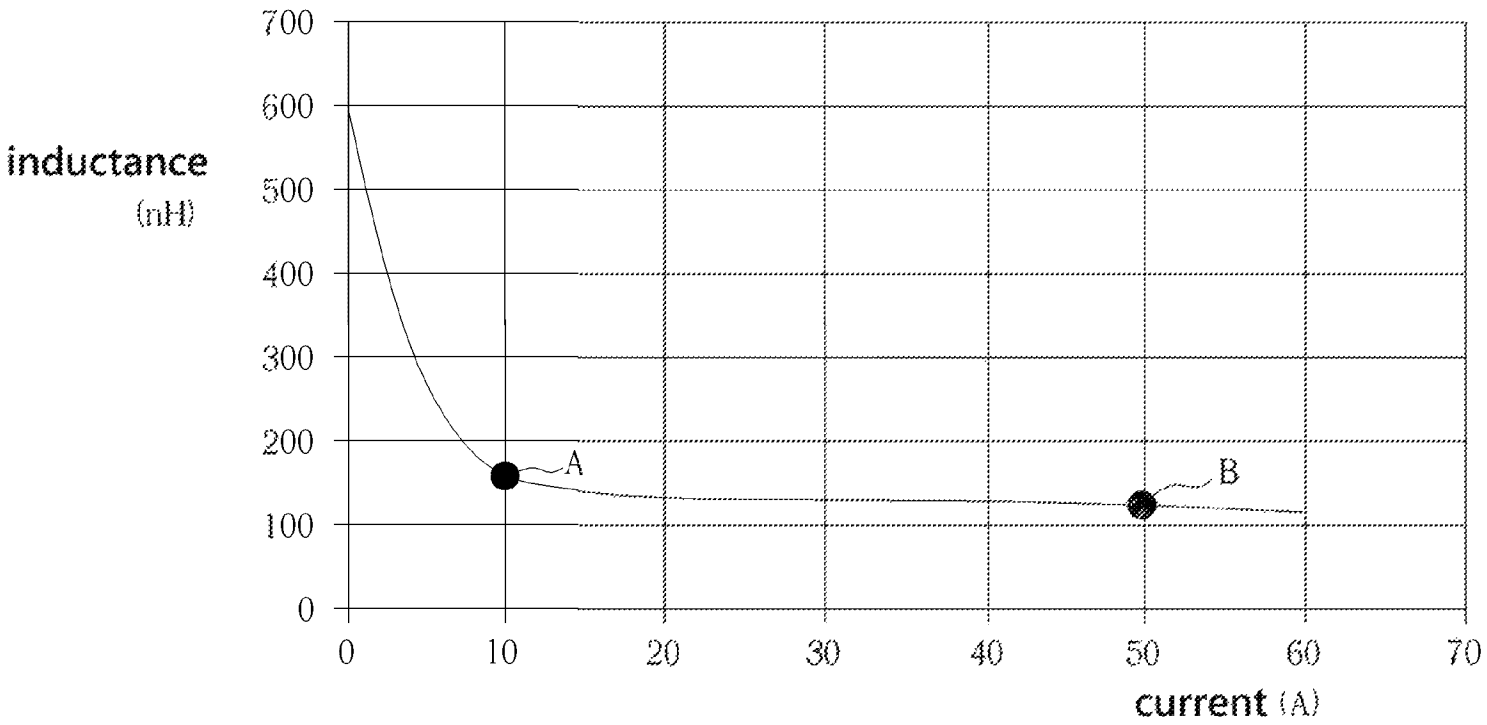
FIG. 5 illustrates the relationships between the measured inductances and the currents in the variable coupled inductor in FIG. 1.

Please refer to FIG. 5 and Table 1. FIG. 5 illustrates the relationship between the inductances and the currents measured in the variable coupled inductor 1 in FIG. 1, and Table 1 lists the inductances and the currents in different measurements. As illustrated in FIG. 5, point A is a conversion point between light-load and heavy-lead situations (In this embodiment, the current at point A is, but not limited to, 10 A.) and the current at the point B is the maximum current to be expected to achieve (In this embodiment, the current at point B is, but not limited to, 50 A.). Herein, Light-load is called when the current is below the point A. From FIG. 5 and Table 1, the inductance of the variable coupled inductor 1 in a light-load situation is apparently enhanced so that the variable coupled inductor 1 of the present invention can effectively improve light-load efficiency. It should be noted that, in this embodiment, the total height H of the variable coupled inductor 1 is about 4.07 mm, the vertical distance D1 of the first gap G1 is between 0.03 mm and 0.2 mm, and the vertical distance D2 of the second gap G2 is between 0.08 mm and 0.7 mm.

TABLE 1

| current (A) | inductance (nH) |
|---|---|
| 0 | 599.6 |
| 5 | 269.8 |
| 10 | 159.35 |
| 11 | 154.38 |
| 12 | 150.52 |
| 13 | 147.55 |
| 14 | 145.29 |
| 15 | 143.61 |
| 20 | 138.05 |
| 25 | 134.3 |
| 30 | 131.45 |
| 35 | 129.3 |
| 40 | 127.4 |
| 45 | 125.5 |
| 50 | 123.6 |
| 55 | 121.7 |
| 60 | 119.8 |

In this embodiment, the magnetic structure 16 has a first surface area A1, and the second protrusion 102 has a second surface area A2. As illustrated in FIG. 3, the length of the magnetic structure 16 and the length of the second protrusion 102 are both X; the width of the magnetic structure 16 is Y1, and the width of the second protrusion 102 is Y2; the first surface area A1 of the magnetic structure 16 is X*Y1; the second surface area A2 of the second protrusion 102 is X*Y2. If the current at point A is defined as a first current I1, and the current at point B is defined as a second current I2, the relationship between the first current I1, the second current I2, the first surface area A1 and the second surface area A2 can represented as 1.21 (I1/I2)≥A1/A2≥0.81 (I1/I2). Furthermore, a first inductance L1 can be measured at the first current I1, and a second inductance L2 can be measured at the second current I2; the relationship between the first inductance L1 and the second inductance L2 can be represented as 0.8L1≥L2≥0.7L1. In other words, the present invention proposes that the first inductance L1 at the first current I1 (i.e. the current at the conversion point between light-load and heavy-lead described above) and the second inductance L2 at the second current I2 (i.e. the maximum current to be expected to achieve) can be adjusted by adjusting the first surface area A1 and the second surface A2.

It should be noted that the first current I1 can be defined as follows. A third inductance L3 is measured when the first current I1 plus 1 amp is applied and 5.5 nH≥L1−L2≥4.5 nH. For example, the first current I1 of this embodiment is 10 A, and the corresponding first inductance L1 is 159.35 nH; the first current I1 plus 1 equals 11 A, and the corresponding third inductance L3 is 154.38 nH, wherein L1−L3=4.97 nH is obtained and 5.5 nH≥4.97 nH≥4.5 nH is satisfied. As defined above, when the current passes through the variable coupled inductor 1 in accordance with present invention, the corresponding current (i.e. the first current I1 described above) at point A in FIG. 4A can be derived by measuring the inductance.

Figure 6:
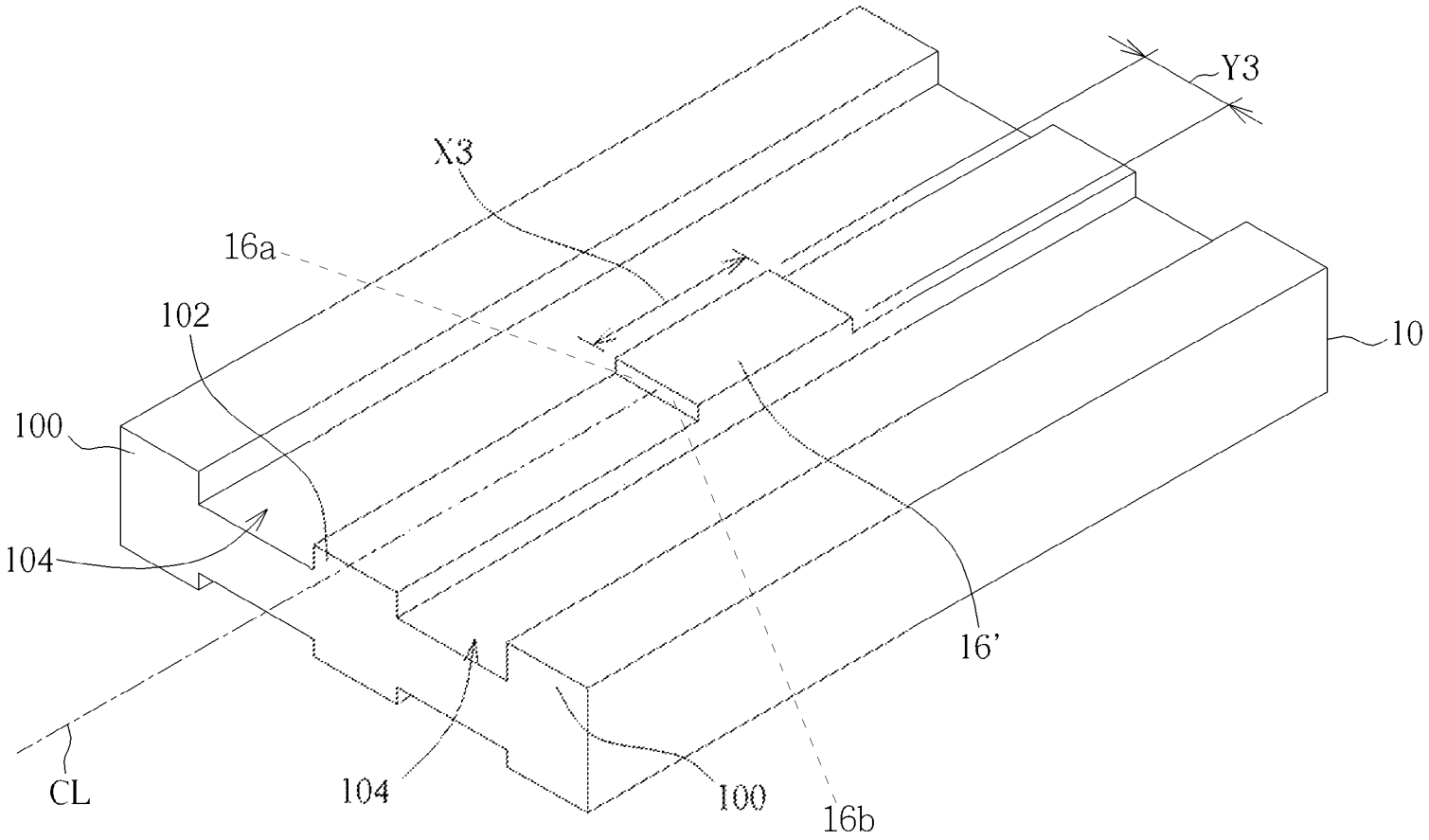
FIG. 6 illustrates a three-dimensional view of the first core and the magnetic structure in accordance with one embodiment of present invention.

Please refer to FIG. 6. FIG. 6 is a three-dimensional view of a first core 10 and a magnetic structure 16' according to another embodiment of the present invention. The main difference between the magnetic structure 16 described above and the magnetic structure 16' is that the length X3 of the magnetic structure 16' is smaller than the length X of the magnetic structure 16, and the width Y3 of the magnetic structure 16' is greater than the width Y1 of the magnetic structure 16. In this embodiment, the surface area X3*Y3 of the magnetic structure 16' is equal to the surface area X*Y1 of the magnetic structure 16. Furthermore, a first portion 16*a* of the magnetic structure 16' is still symmetric to a second portion 16*b* of the magnetic structure 16' with respect to the central line CL of the second protrusion 102. It should be noted that the magnetic structure 16' and the first core 10 can be integrally formed or the magnetic structure 16' and the second core 14 can be integrally formed. Alternatively, the magnetic structure 16' can be an independent device.

Figure 7:
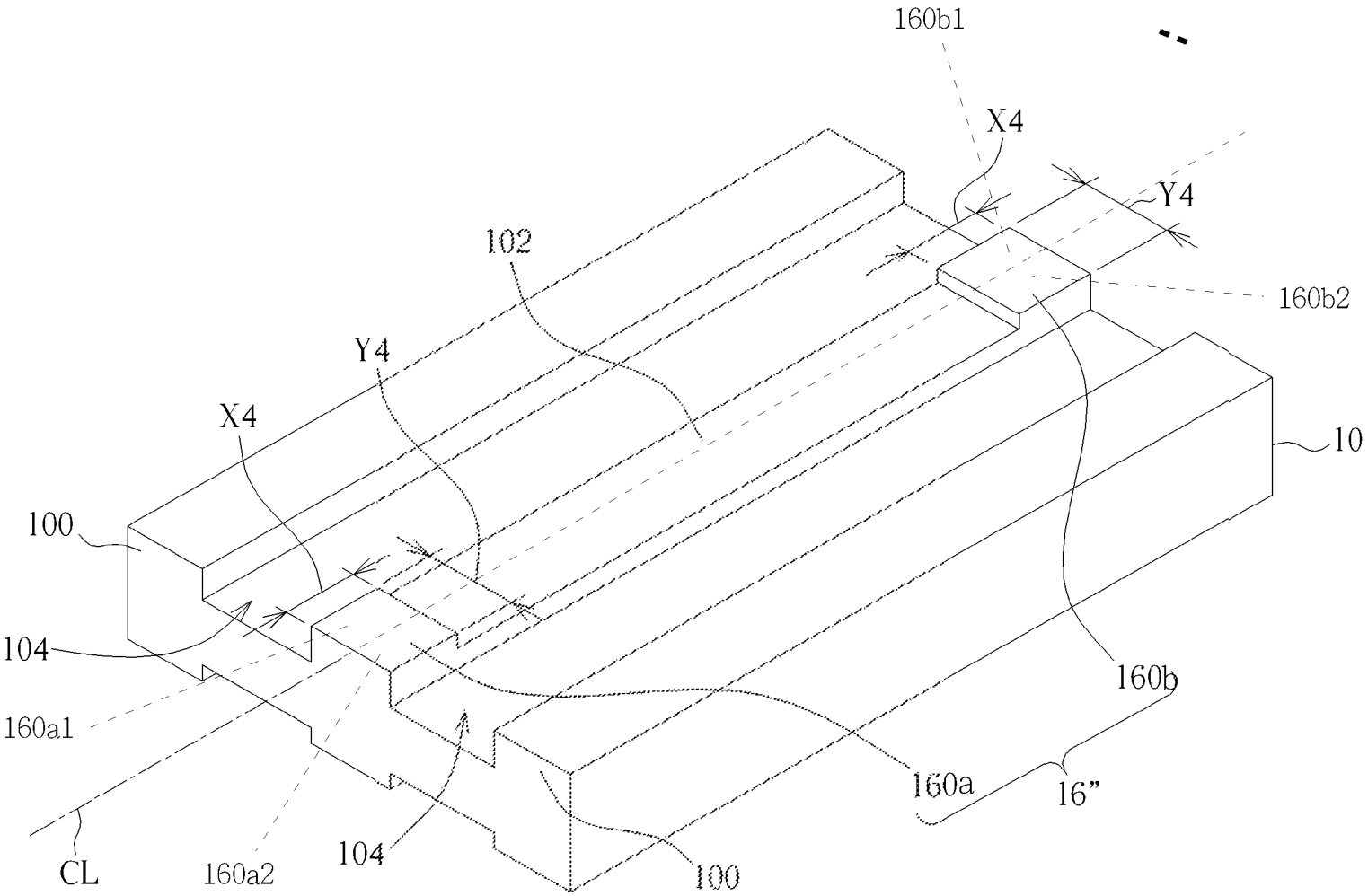
FIG. 7 illustrates a three-dimensional view of the first core and the magnetic structure in accordance with another embodiment of present invention.

Please refer to FIG. 7. FIG. 7 is a three-dimensional view of a first core 10 and a magnetic structure 16" according to another embodiment of the present invention. The main difference between the magnetic structure 16 described above and the magnetic structure 16" is that the magnetic structure 16" comprises two segments 160*a*, 160*b*, and the length and the width of each segment 160*a*, 160*b* are respectively X4 and Y4. In this embodiment, the surface area (X4*Y4)*2 of the magnetic structure 16" is equal to the surface area X*Y1 of the magnetic structure 16. Furthermore, the magnetic structure 16" is still symmetric with respect to the central line CL of the second protrusion 102, wherein a first portion 160*a*1 of the segment 160*a* is symmetric to a second portion 160*a*2 of the segment 160*a* with respect to the central line CL of the second protrusion 102, and a first portion 160*b*1 of the segment 160*b* is symmetric to a second portion 160*b*2 of the segment 160*b* with respect to the central line CL of the second protrusion 102. It should be noted that the magnetic structure 16" and the first core 10 can be integrally formed or the magnetic structure 16" and the second core 14 can be integrally formed. Alternatively, the magnetic structure 16" can be an independent device.

Figure 8:
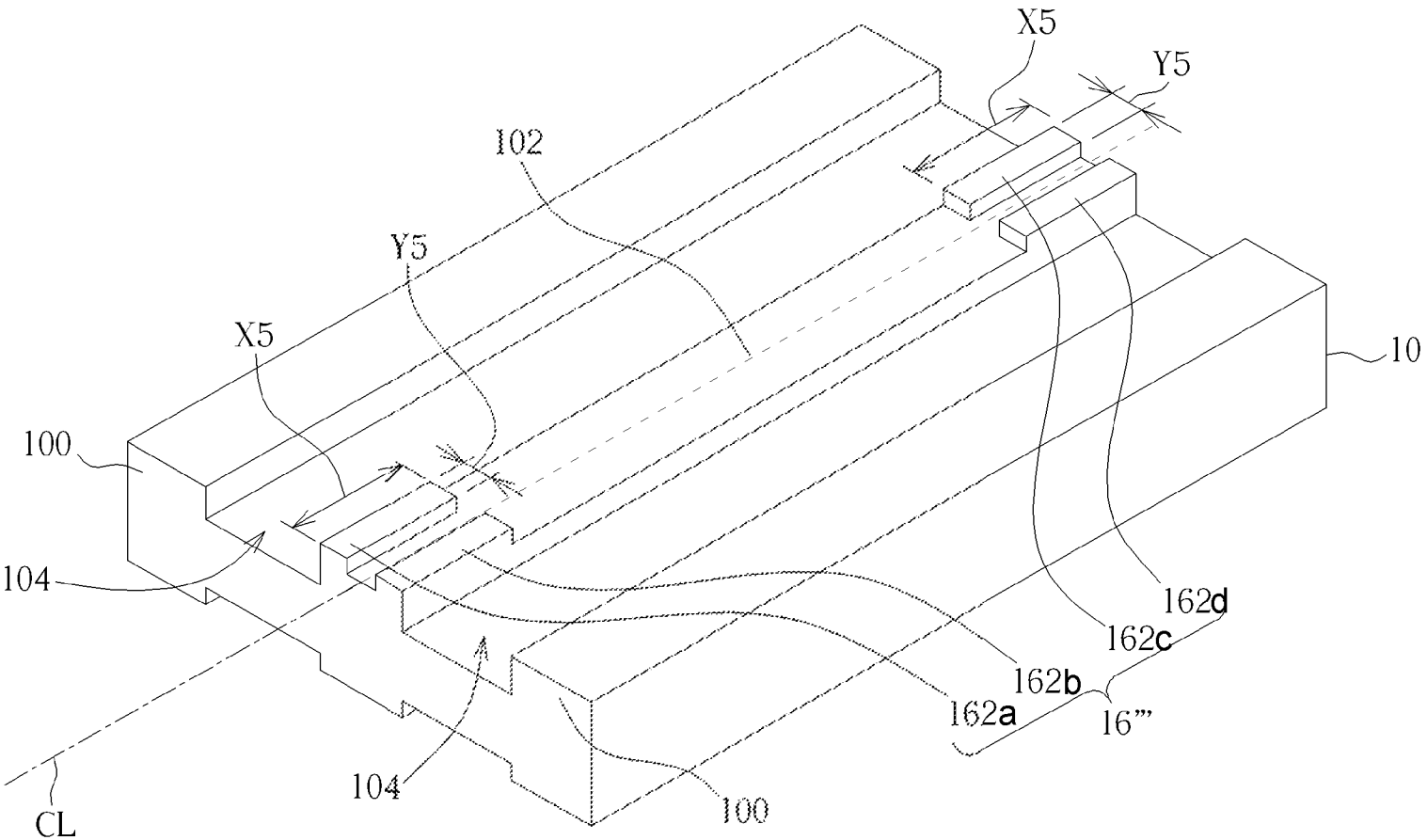
FIG. 8 illustrates a three-dimensional view of the first core and the magnetic structure in accordance with yet another embodiment of present invention.

Please refer to FIG. 8. FIG. 8 is a three-dimensional view of a first core 10 and a magnetic structure 16''' according to another embodiment of the present invention. The main difference between the magnetic structure 16 described above and the magnetic structure 16''' is that the magnetic structure 16''' comprises four segments 162*a*, 162*b*, 162*c*, 162*d*, and the length and the width of each segment are X5 and Y5 respectively. In this embodiment, the surface area (X5*Y5)*4 of the magnetic structure 16''' is equal to the surface area X*Y1 of the magnetic structure 16. Furthermore, the magnetic structure 16''' is still symmetric with respect to the central line CL of the second protrusion 102, wherein 162*a* is symmetric to 162*b* with respect to the central line CL of the second protrusion 102, and 162*c* is symmetric to 162*d* with respect to the central line CL of the second protrusion 102. That is, a first portion 162*a*, 162*c* of the four segments is symmetric to a second portion 162*b*, 162*d* of the four segments 162*a*, 162*b*, 162*c*, 162*d*. It should be noted that the magnetic structure 16''' and the first core 10 can be integrally formed or the magnetic structure 16''' and the second core 14 can be integrally formed. Alternatively, the magnetic structure 16''' can be an independent device.

In other words, the number of the segments and appearance of the magnetic structure can be designed in many ways as long as the same surface area is maintained. The magnetic structure is symmetric with respect to the central line CL of the second protrusion 102 regardless of the number of the segments and appearance of the magnetic structure In conclusion, the present invention proposes that the magnetic structure is disposed between the second projection 102 in the middle of the first core 10 and the second core, and the magnetic structure is symmetric with respect to the central line CL of the second protrusion 102. Therefore, the initial-inductance of the variable coupled inductor can be enhanced and light-load efficiency can be improved by means of the magnetic structure. Furthermore, the material of the variable coupled inductor of the present invention can be a ferrite material to achieve a high-saturation current, and copper sheet is used as an electrode to reduce the DC resistance, so efficiency is better in heavy-load. In other words, the variable coupled inductor of the present invention can improve efficiency in both light-load and heavy-load situations.

The above disclosure is related to the detailed technical contents and inventive features thereof. People skilled in the art may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. A variable coupled inductor, comprising:

a first core having a top surface and a bottom surface, a first lateral surface and a second lateral surface opposite to the first lateral surface, wherein the first core comprises a first protrusion, a second protrusion, a third protrusion, a first conducting-wire groove and a second conducting-wire groove, each of which extending from the first lateral surface to the second lateral surface on the top surface, wherein the second protrusion is disposed between the first protrusion and the third protrusion, wherein a first conducting wire is disposed in the first conducting-wire groove with a portion of the first conducting wire extending from the first lateral surface to the second lateral surface, and a second conducting wire is disposed in the second conducting-wire groove with a portion of the second conducting wire extending from the first lateral surface to the second lateral surface; and a second core, disposed over the first core, wherein a magnetic structure is integrally formed with the second core and protruded on a bottom surface of the second core, wherein a bottom surface of the magnetic structure is located over a top surface of the second protrusion, wherein the top surface of the second protrusion is respectively lower than a top surface of the first protrusion and a top surface of the third protrusion, and the top surface of the second protrusion is respectively higher than a bottom surface of the first conducting-wire groove and a bottom surface of the second conducting-wire groove, wherein the bottom surface of the magnetic structure is disposed on and in contact with the top surface of the second protrusion and a total area of the bottom surface of the magnetic structure is smaller than a total area of the top surface of the second protrusion with side surfaces of the second protrusion being not used for winding a conductive wire therearound.

2. The variable coupled inductor according to claim 1, wherein a first gap is formed between the top surface of the first protrusion and the bottom surface of the second core, a second gap is formed between the top surface of the second protrusion and the bottom surface of the second core and a third gap is formed between the top surface of the third protrusion and the bottom surface of the second core, wherein a vertical distance of each of the first gap and the third gap is respectively smaller than a vertical distance of the second gap, wherein the variable coupled inductor has a height H, and the vertical distance of each of the first gap and the third gap is between 0.0073H and 0.0492H, and the vertical distance of the second gap is between 0.0196H and 0.1720H.

3. The variable coupled inductor according to claim 2, wherein the magnetic structure has a first magnetic permeability $\mu 1$, each of the first gap and the third gap has a second magnetic permeability $\mu 2$, and the second gap has a third magnetic permeability $\mu 3$, wherein a relationship between the first magnetic permeability $\mu 1$, the second magnetic permeability $\mu 2$ and the third magnetic permeability $\mu 3$ is: $\mu 1 > \mu 2 \geq \mu 3$.

4. The variable coupled inductor according to claim 2, wherein the first core has a fourth magnetic permeability $\mu 4$, and the second core has a fifth magnetic permeability $\mu 5$, wherein a relationship between the first magnetic permeability $\mu 1$, the second magnetic permeability $\mu 2$, the third magnetic permeability $\mu 3$, the fourth magnetic permeability $\mu 4$ and the fifth magnetic permeability $\mu 5$ is: $\mu 1 \geq \mu 4 > \mu 2 \geq \mu 3$ and $\mu 1 \geq \mu 5 > \mu 2 \geq \mu 3$.

5. The variable coupled inductor according to claim 1, wherein a first gap is formed between the top surface of the first protrusion and the bottom surface of the second core, wherein the first gap is filled with a non-magnetic material.

6. The variable coupled inductor according to claim 5, wherein a third gap is formed between the top surface of the third protrusion and the bottom surface of the second core, wherein the third gap is filled with a non-magnetic material.

7. A variable coupled inductor, comprising:

a first core having a top surface and a bottom surface, a first lateral surface and a second lateral surface opposite to the first lateral surface, wherein the first core comprises a first protrusion, a second protrusion, a third protrusion, a first conducting-wire groove and a second conducting-wire groove, each of which extending from the first lateral surface to the second lateral surface on the top surface, wherein the second protrusion is disposed between the first protrusion and the third protrusion, wherein a first conducting wire disposed in the first conducting-wire groove with a portion of the first conducting wire extending from the first lateral surface to the second lateral surface, and a second conducting wire disposed in the second conducting-wire groove with a portion of the second conducting wire extending from the first lateral surface to the second lateral surface; and a second core, disposed over the first core, wherein a magnetic structure is integrally formed with the second core and protruded on a bottom surface of the second core, wherein a bottom surface of the magnetic structure is located over a top surface of the second protrusion, wherein the top surface of the second protrusion is respectively lower than a top surface of the first protrusion and a top surface of the third protrusion, and the top surface of the second protrusion is respectively higher than a bottom surface of the first conducting-wire groove and a bottom surface of the second conducting-wire groove, wherein a total area of the bottom surface of the magnetic structure is A1, and a total area of the top surface of the second protrusion is A2, wherein A1/A2 is configured in a pre-determined value based on a pre-determined current value at a conversion point between light load and heavy load situations of the variable coupled inductor, wherein the bottom surface of the magnetic structure is disposed on and in contact with the top surface of the second protrusion and the total area of the bottom surface of the magnetic structure is smaller than the total area of the top surface of the second protrusion with side surfaces of the second protrusion being not used for winding a conductive wire therearound.

8. The variable coupled inductor according to claim 7, wherein a first gap is formed between the top surface of the first protrusion and the bottom surface of the second core, a second gap is formed between the top surface of the second protrusion and the bottom surface of the second core and a third gap is formed between the top surface of the third protrusion and the bottom surface of the second core, wherein a vertical distance of each of the first gap and the third gap is respectively smaller than a vertical distance of the second gap, wherein the variable coupled inductor has a height H, and the vertical distance of each of the first gap and the third gap is between 0.0073H and 0.0492H, and the vertical distance of the second gap is between 0.0196H and 0.1720H.

9. The variable coupled inductor according to claim 8, wherein the magnetic structure has a first magnetic permeability $\mu 1$, each of the first gap and the third gap has a second magnetic permeability $\mu 2$, and the second gap has a third magnetic permeability $\mu 3$, wherein a relationship between the first magnetic permeability $\mu 1$, the second magnetic permeability $\mu 2$ and the third magnetic permeability $\mu 3$ is: $\mu 1 > \mu 2 \geq \mu 3$.

10. The variable coupled inductor according to claim 8, wherein the first core has a fourth magnetic permeability $\mu 4$, and the second core has a fifth magnetic permeability $\mu 5$, wherein a relationship between the first magnetic permeability $\mu 1$, the second magnetic permeability $\mu 2$, the third magnetic permeability $\mu 3$, the fourth magnetic permeability $\mu 4$ and the fifth magnetic permeability $\mu 5$ is: $\mu 1 \geq \mu 4 > \mu 2 \geq \mu 3$ and $\mu 1 \geq \mu 5 > \mu 2 \geq \mu 3$.

11. The variable coupled inductor according to claim 7, wherein a first gap is formed between the top surface of the first protrusion and the bottom surface of the second core, wherein the first gap is filled with a non-magnetic material.

12. The variable coupled inductor according to claim 11, wherein a third gap is formed between the top surface of the third protrusion and the bottom surface of the second core, wherein the third gap is filled with a non-magnetic material.

* * * * *